United States Patent [19]

Nonami

[11] Patent Number: 4,837,598

[45] Date of Patent: Jun. 6, 1989

[54] IMAGE ERASING APPARATUS

[75] Inventor: Hidetaka Nonami, Tokyo, Japan

[73] Assignee: Kabushiki Kaisha Toshiba, Kawasaki, Japan

[21] Appl. No.: 150,256

[22] Filed: Jan. 29, 1988

[30] Foreign Application Priority Data

Jan. 31, 1987 [JP] Japan ..... 62-21031

[51] Int. Cl.[4] ..... G03G 15/00; G03G 15/048

[52] U.S. Cl. ..... 355/218; 355/215

[58] Field of Search ..... 355/3 CH, 3 R, 7, 14 E

[56] References Cited

U.S. PATENT DOCUMENTS

| | | | |
|---|---|---|---|
| 4,582,417 | 4/1986 | Yagasaki et al. | 355/7 |
| 4,627,707 | 12/1986 | Tani et al. | 355/14 R |
| 4,653,899 | 3/1987 | Watanabe | 355/14 R |
| 4,740,818 | 4/1988 | Tsilibes et al. | 355/7 X |

FOREIGN PATENT DOCUMENTS

| | | |
|---|---|---|
| 58-43480 | 3/1983 | Japan . |
| 61-177474 | 8/1986 | Japan . |
| 61-177475 | 8/1986 | Japan . |
| 61-177476 | 8/1986 | Japan . |
| 62-47667 | 3/1987 | Japan . |

*Primary Examiner*—A. C. Prescott

*Attorney, Agent, or Firm*—Foley & Lardner, Schwartz, Jeffery, Schwaab, Mack, Blumenthal & Evans

[57] ABSTRACT

An erasing array for erasing an image on a photosensitive drum of a copying machine includes an auxiliary printed board. A surface of the auxiliary printed board opposes a surface of the photosensitive drum. A plurality of LED chips are directly bonded, at a predetermined pitch, to the surface of the auxiliary printed board. The surface of the auxiliary printed board is covered by a casing which independently covers the plurality of LED chips. The casing includes a plurality of window holes for guiding light emitted from the LED chips onto the photosensitive drum. Gaps are respectively formed between the window holes and the LED chips. Parts such as a lens are not arranged in the gaps. A dustproof film is adhered to the casing, to prevent dust from entering the case through the window holes. The film covers the window holes and transmits therethrough the light emitted from the LED chips.

8 Claims, 7 Drawing Sheets

IMAGE ERASING APPARATUS

BACKGROUND OF THE INVENTION

The present invention relates to an image erasing apparatus for erasing an image formed on an image carrier such as a photosensitive drum used in a copying machine.

Conventional image erasing apparatuses used in copying machines can be categorized into two types, i.e., one having an erasing array as shown in FIG. 1, and one having an erasing array as shown in FIG. 2. These apparatuses are disclosed in Japanese Patent Disclosure (Kokai) Nos. 61-177474, 61-177475, 61-177476, and 62-47667.

Erasing array unit 2 shown in FIG. 1 has main printed board 4 on which are mounted ICs (integrated circuits), resistors, capacitors, and the like (all of which are not shown). Auxiliary printed board 8 is connected to main printed board 4 via connecting wiring 6, and has a plurality of light-emitting elements such as light-emitting diode (LED) chips 10 directly bonded to a surface thereof. In addition, the surface of auxiliary printed board 8 is covered with casing 12 such that LED chips 10 are independently covered thereby. Casing 12 is fixed to main printed board 4, and has window holes 14 formed therein which respectively correspond to LED chips 10. Each window hole 14 serves to guide light emitted from its respective LED chip 10 toward a predetermined part of photosensitive drum 16. Transparent dustproof film 18 is adhered to a surface of casing 12, to prevent dust from entering thereinto through window hole 14. Lens 20 is interposed between film 18 and LED chips 10.

Erasing array unit 22 shown in FIG. 2 has main printed board 24 on which are mounted ICs (integrated circuits), resistors, capacitors, and the like (all of which are not shown). Auxiliary printed board 28 is connected to main printed board 24 via connecting wiring 26, and has a plurality of light-emitting elements such as discrete type (lamp bulb type) LEDs 30 are directly bonded to a surface thereof. LEDs 30 is designed such that lens 34 is integrally formed on LED chip 32. In addition, the surface of auxiliary printed board 28 is covered with casing 36 such that LEDs 30 are independently covered thereby. Casing 36 is fixed to main printed board 24, and has windows 38 formed therein which respectively correspond to LEDs 30. Each window 38 serves to guide light emitted from its respective LED 30 toward a predetermined part of photosensitive drum 40. Transparent dustproof film 42 is adhered to a surface of casing 36, to prevent dust from entering thereinto unit through window 38.

In erasing array unit 2 shown in FIG. 1, since lens 20 is arranged between LED chips 10 and film 18, distance L between LED chips 10 and photosensitive drum 16 is increased by the thickness of lens 20. As a result, illuminance on photosensitive drum 16 is decreased. Component parts and assembly steps are increased in number, resulting in an increase in cost. Furthermore, since the optical axes of lens 20 and LED chips 10 tend to deviate from each other, when light emitted from ON LED chip 10 propagates through corresponding lens 20 while being refracted, part thereof is guided to lens 20 corresponding to adjacent OFF LED chip 10, thereby resulting in a stray light phenomenon. Thus, an image formed outside a designated erase range is erased.

In erasing array 22 shown in FIG. 2, since discrete type LED 30 having lens 34 integrally formed on LED chip 32 is used, a distance between LED chip 32 and photosensitive drum 40 is increased by the height of LEDs 30. As a result, illuminance on photosensitive drum 40 is decreased. Furthermore, since it is difficult to mount LEDs 30 on auxiliary printed board 28 with high precision, accurate positioning of LED 30 with respect to window 38 of casing 36 cannot be easily achieved. Therefore, an image within a predetermined erase range cannot be erased with high precision.

SUMMARY OF THE INVENTION

It is an object of the present invention to provide an image erasing apparatus, the manufacturing cost of which can be decreased through a reduction in the number of component parts and assembly steps, and in which illuminance on an image carrier is increased, while an erase range can be designated with high precision.

According to an aspect of the present invention, there is provided an image erasing apparatus for erasing an image on an image carrier of a copying machine, comprising:

a base including a surface facing said image carrier;

a plurality of light-emitting elements formed, at a predetermined pitch, on the surface of said base;

casing means for independently covering said plurality of light-emitting elements, said casing including a plurality of windows for guiding light emitted from said plurality of light-emitting elements onto said image carrier, and gaps respectively formed between said light-emitting elements and said windows; and dustproof means, arranged to cover said windows and to transmit therethrough light emitted from said light-emitting elements, for preventing dust from entering said casing means through said windows.

According to such an arrangement, only a dustproof film is interposed between a light-emitting element and an image carrier without interposing a lens. As a result, a distance between the light-emitting element and the image carrier can be decreased, thereby increasing illuminance on the image carrier, while decreasing the number of parts. In addition, the light-emitting elements can be positioned with high precision, and the number of assembly steps can be reduced. In addition, the stray light phenomenon can be reliably prevented, and hence an image within a designated range can be erased with high precision.

DETAILED DESCRIPTION OF THE PREFERRED EMBODIMENT

An embodiment of the present invention will now be described, with reference to the accompanying drawings.

Figure 1:
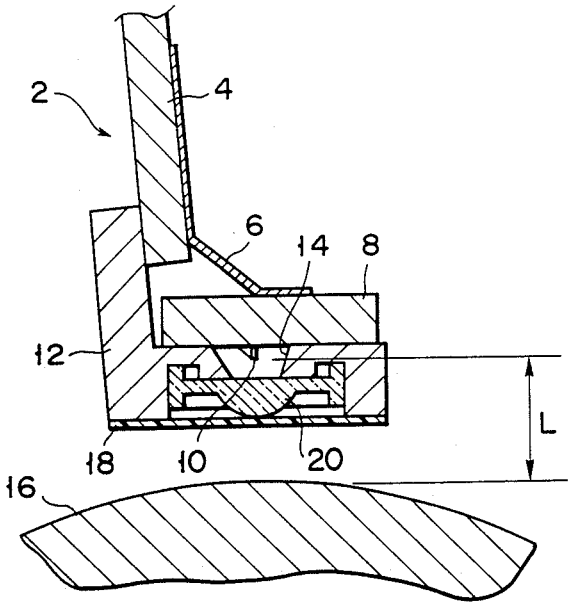
FIG. 1 is a sectional view showing a conventional image erasing apparatus.
Figure 2:
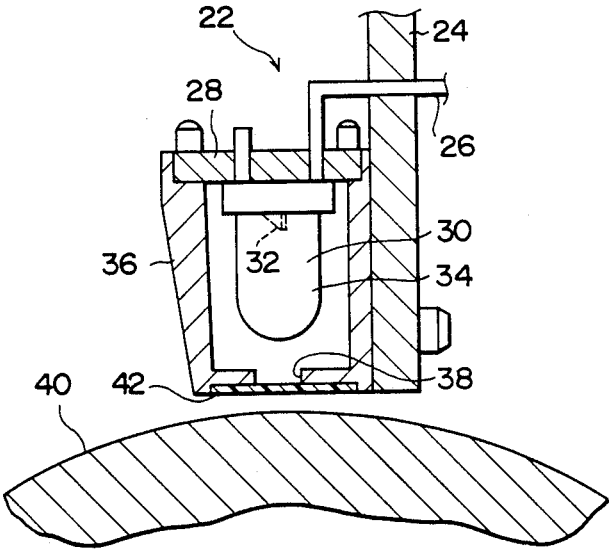
FIG. 2 is a sectional view showing another conventional image erasing apparatus.
Figure 3:
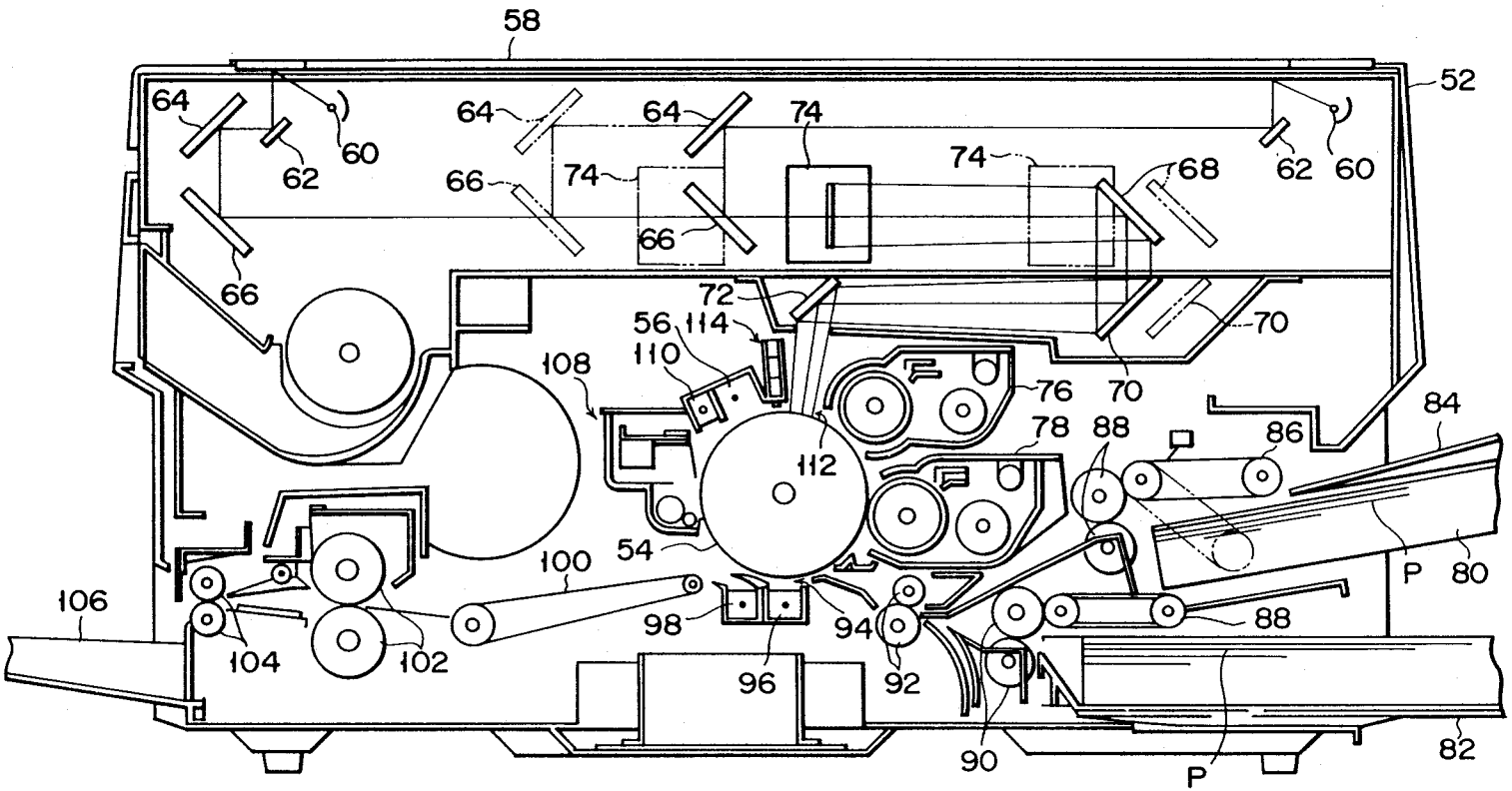
FIG. 3 is a schematic sectional view showing a copying machine.

FIG. 3 shows a copying machine using an image erasing apparatus according to the present invention. Referring to FIG. 3, reference numeral 52 denotes a housing. Photosensitive drum 54 is rotatably supported at substantially the center of housing 52. A surface of photosensitive drum 54 is uniformly charged by charger 56. Document table 58 made of transparent glass is mounted on the upper surface of housing 52. A document (not shown) placed on document table 58 is irradiated by exposure lamp 60. Reflected light from the irradiated document is guided onto photosensitive drum 54 via mirrors 62, 64, 66, 68, 70, and 72, and lens 74. At the same time, exposure lamp 60 and mirror 62 are moved at a speed twice that of mirrors 64 and 66, as a result of which an electrostatic latent image is formed on photosensitive drum 54. Developer is applied to the electrostatic latent image by first and second developing units 76 and 78, thereby forming a developed image, i.e., a toner image. Upper and lower paper feed cassettes 80 and 84 are arranged on one side of housing 52. Paper insertion guide 84 is provided on the upper surface of upper paper feed cassette 80. Paper P, whether extracted from the upper or lower paper feed cassette by pickup rollers 86 or 87 or inserted through paper insertion guide 84, is supplied to transfer section 94 through feed rollers 88 and 90, and registration rollers 92, and electrostatically adhered to the surface of photosensitive drum 54. In transfer section 94, the toner image formed on photosensitive drum 54 is transferred onto paper P by transfer charger 96. Thereafter, paper P is separated from photosensitive drum 54 by AC corona discharge of separation charger 98, and is conveyed to fixing unit 102 by conveyor belt 100. The toner image transferred onto paper P is melted and fixed thereon by fixing unit 102. Subsequently, paper P is discharged onto discharge tray 106 by discharge rollers 104.

After the toner image has been transferred onto paper P, the residual developer on photosensitive drum 54 is removed by cleaner 108. After the residual developer is removed, the surface potential of photosensitive drum 54 is then lowered, by discharge lamp 110, to below as given level, whereby the surface of drum 54 is prepared for the next copying operation.

Erasing array 114 serving as an image erasing apparatus is arranged, between charger 56 and exposing unit 112, such that it extends along the axial direction of photosensitive drum 54 and is located in proximity thereto. When an erase range of a document image is designated by an erase range designating apparatus (not shown), a portion of the electrostatic latent image corresponding to the designated range is erased by erasing array 114.

Figure 4:
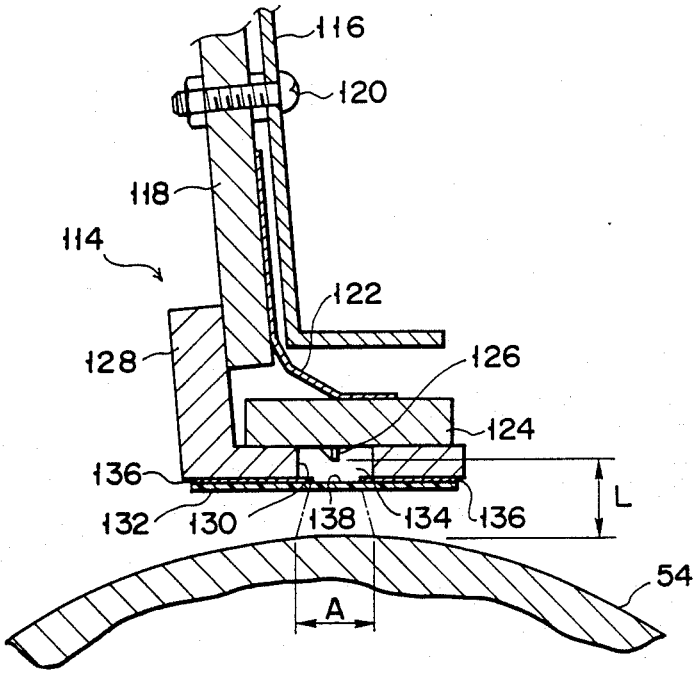
FIG. 4 is a sectional view showing an image erasing apparatus according to an embodiment of the present invention.

As is shown in FIG. 4, erasing array 114 includes holder plate 116, to which main printed aboard 118 is fixed, by means of screw 120. Mounted on board 118 are ICs (integrated circuits), resistors, capacitors, and the like (all of which are not shown). Auxiliary printed board 124 is connected to main printed board 118, via connecting wiring 122. A plurality of light-emitting elements such as LED chips 126 are directly bonded, at a predetermined pitch, to that surface board 124 facing away from photosensitive drum 54 (i.e., the lower surface), by means of, for example, an automatic assembly system (refer to FIG. 5). Casing 128 covers the surface of auxiliary printed board 124 so as to independently cover LED chips 126. Casing 128 is fixed to main printed board 118. In addition, window holes 130 are formed in casing 128 so as to correspond LED chips 126, respectively. Window holes 130 are formed facing predetermined portions on photosensitive drum 54. Furthermore, transparent dustproof film 132 is adhered to the surface of casing 128, to prevent dust from entering thereinto through window holes 130. Gap space 134 is formed between film 132 and LED chip 126. Parts such as a lens are not arranged in gap space 134.

Figure 6:
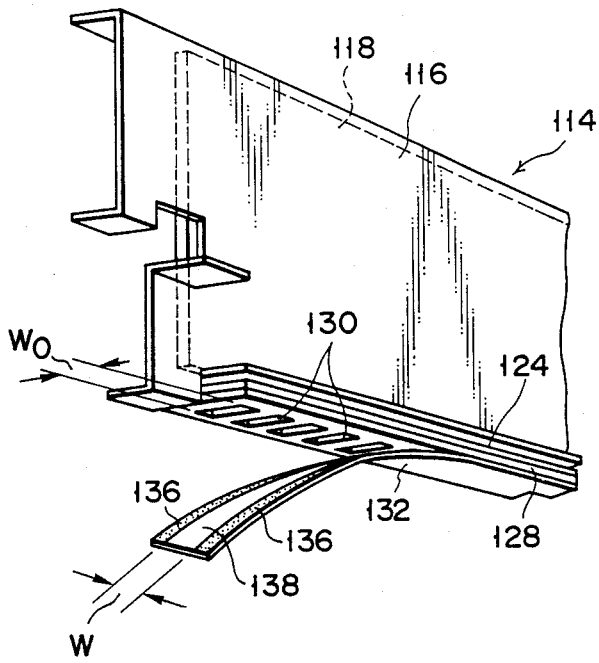
FIG. 6 is a perspective view showing a state wherein part of a dustproof film of the apparatus shown in FIG. 4 is peeled.
Figure 7:
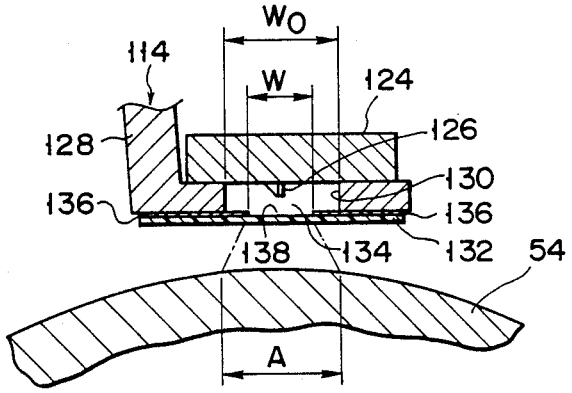
FIG. 7 is a view for explaining luminance adjustment of an LED chip of the apparatus shown in FIG. 4.

As is shown in FIGS. 6 and 7, film 132 is adhered to the surface of casing 128 so as to cover window holes 130. Opaque films 136 are printed on both sides of film 132. As a result, slit portion 138 is formed between opaque films 136 such that it extends along the axial direction of photosensitive drum 54. Width W of slit portion 138 is adjusted according to illuminance of each lot of LED chips 126. Accordingly, the width of the light beams radiated from LEDs chip 126 onto photosensitive drum 54 can be adjusted regardless of width $W_0$ of window hole 130 of casing 128, thereby maintaining constant the size of image erase range A on photosensitive drum 54.

Figure 8:
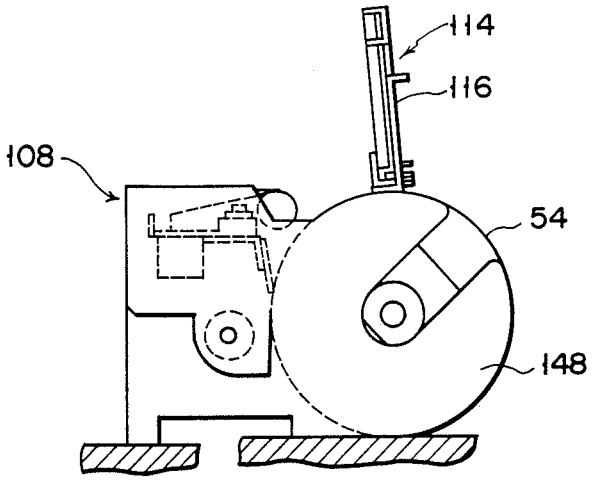
FIGS. 8 and 9 are views for explaining a method of positioning the apparatus shown in FIG. 4 to the copying machine, respectively.
Figure 9:
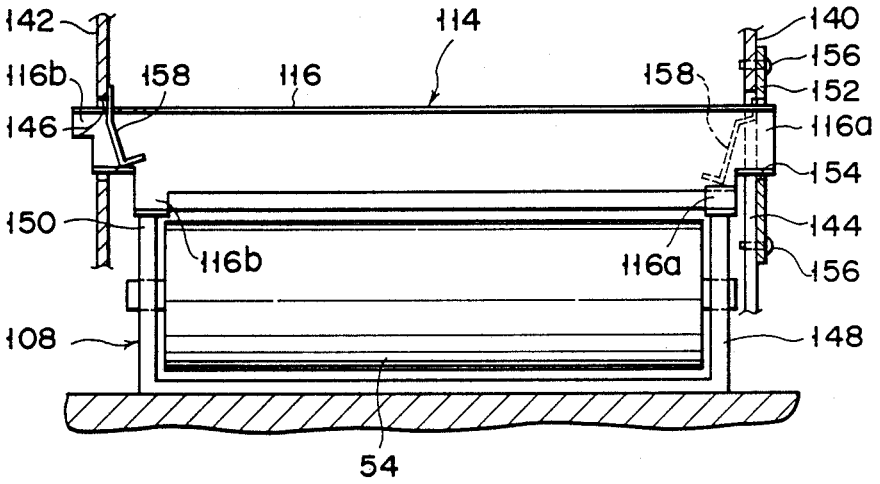

As is shown in FIGS. 8 and 9, front and rear frames 140 and 142 are arranged inside housing 52. Insertion portion 144 is notched in front frame 140, and insertion hole 146 is formed in rear frame 142. Erasing array 114 is inserted between front and rear frames 140 and 142, through insertion portion 144. Subsequently, front and rear end portions **116*a* and 116*b* of holder plate erasing array 114 are mounted on front and rear frame portions 148 and 150 of cleaner 108, respectively. Rear end portion 116*b* of holder plate 116 is inserted into insertion hole 146 of rear frame 142, and can be moved only vertically inside hole 146. Front end portion 116*a* of holder plate 116 is inserted into insertion hole 154 of stationary plate 152 located on the front side of front frame 140. Front end portion 116*a* can be moved only vertically inside hole 154. Thereafter, stationary plate 152 is fixed to front frame 140, by means of a plurality of machine screws 156. Tension plates 158 are respectively provided to front and rear frames 140 and 142. Front and rear end portions 116*a* and 116*b* of holder plate 116 are elastically urged against front and rear frame portions 148 and 150 of cleaner 108 by tension plates 158, respectively, thereby facilitating positioning of erasing array 114**.

In this manner, erasing array 114 is positioned by urging it against front and rear side frame portions 148 and 150 of cleaner 108. As a result, the positions of LED chips 126 of erasing array 114 can be maintained with high precision in relation to the surface of photosensitive drum 54, thereby ensuring accurate and reliable image erasure.

Figure 5:
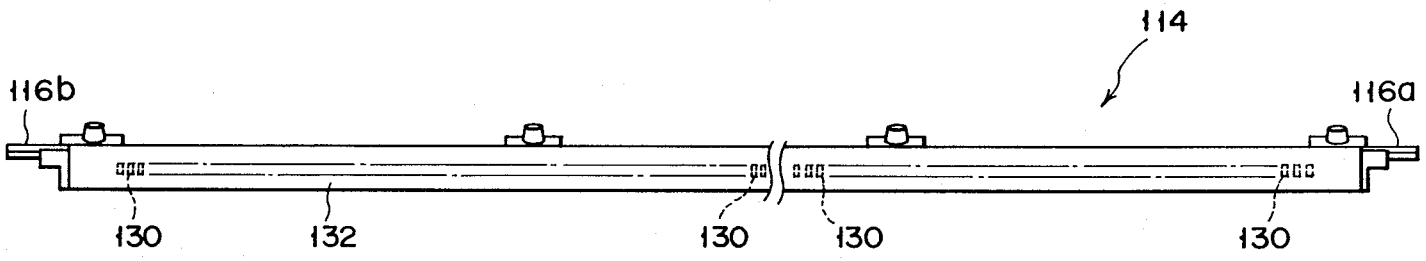
FIG. 5 is a bottom view of the apparatus shown in FIG. 4.
Figure 10:
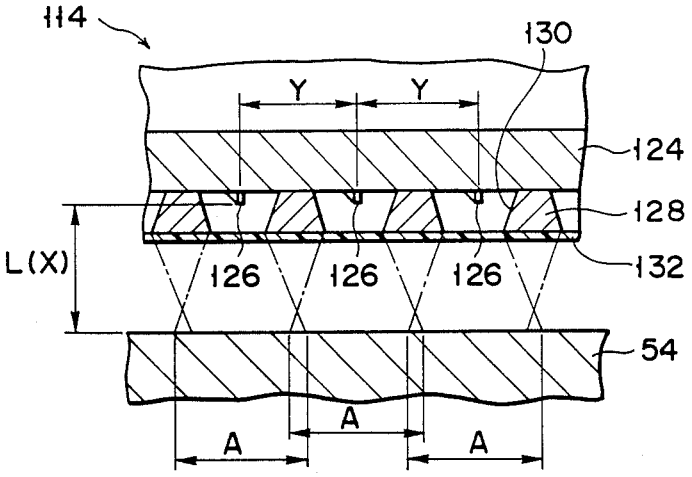
FIG. 10 is a schematic view showing a relationship between a position of the apparatus shown in FIG. 4 and that of a photosensitive drum.

When distance L between the surface of photosensitive drum 54 and LED chips 126 of erasing array 114 is X, as shown in FIG. 5, and the pitch between adjacent LED chips 126 is Y, as shown in FIG. 10, positioning of photosensitive drum 54 with respect to each LED chip 126 of erasing array 114 is performed in such a manner that the following relation is established:

$$(\tfrac{1}{2}Y) \leqq X \leqq 2Y$$

Figure 11:
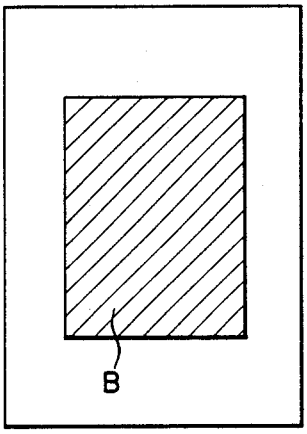
FIG. 11 is a view showing an image erase portion.

If distance X between photosensitive drum 54 and LEDs chip 126 and pitch Y between adjacent LED chips 126 are 2.5 mm, respectively, erase range A designated by light emitted from each of adjacent LED chips 126 is 3.5 mm. An overlapped portion of erase range A is 0.5 mm, thereby clarifying a boundary of hatched portion B shown in FIG. 11.

According to the above-described arrangement, only dustproof film 132 is interposed between LED chips 126 and photosensitive drum 54, and parts such as a lens are not interposed. As a result, the distance between LED chips 126 and photosensitive drum 54 can be decreased, thereby increasing illuminance on photosensitive drum 54. In addition, the number of component parts can be reduced, as can the number of assembly steps, highly precise positioning of LED chips 126 can be achieved. Furthermore, since no lens is interposed, the stray light phenomenon can be assuredly prevented, ensuring that an image within a designated range can be erased with high precision.

What is claimed is:

1. An image erasing apparatus for erasing an image on an image carrier of a copying machine, comprising:

a base including a surface facing said image carrier;

a plurality of light-emitting elements formed, at a predetermined pitch, on the surface of said base;

casing means for independently covering said plurality of light-emitting elements, said casing including a plurality of windows for guiding light emitted from said plurality of light-emitting elements onto said image carrier, and gaps respectively formed between said light-emitting elements and said windows; and dustproof means, arranged to cover said windows and to transmit therethrough light emitted from said light-emitting elements, for preventing dust from entering said casing means through said windows.

2. The apparatus according to claim 1, wherein said, dustproof means comprises a transparent film.

3. The apparatus according to claim 1, wherein said dustproof means includes a transparent film, and an opaque film formed on the transparent film, for controlling the width of light passing through the transparent film.

4. The apparatus according to claim 3, wherein said opaque film is printed on said transparent film.

5. The apparatus according to claim 1, wherein said image carrier is movably arranged, and said light-emitting elements are disposed along a direction crossing a moving direction of said image carrier.

6. The apparatus according to claim 5, wherein said image carrier comprises a rotary drum for carrying an image on a surface thereof, and said light-emitting elements are disposed along a rotating axis of said drum.

7. The apparatus according to claim 1, wherein said light-emitting elements are directly bonded to the surface of said base.

8. The apparatus according to claim 1, wherein said light-emitting elements comprise light-emitting diodes.

* * * * *